US006672102B1

(12) United States Patent
Huenniger et al.

(10) Patent No.: US 6,672,102 B1
(45) Date of Patent: Jan. 6, 2004

(54) OIL RECOVERY AND LUBRICATION SYSTEM FOR SCREW COMPRESSOR REFRIGERATION MACHINE

(75) Inventors: Edward A. Huenniger, Liverpool, NY (US); Nadine Thompson, Liverpool, NY (US); Joseph A. Catrambone, Pompey, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/306,784

(22) Filed: Nov. 27, 2002

(51) Int. Cl.[7] ..... F25B 43/02
(52) U.S. Cl. ..... 62/472; 62/510
(58) Field of Search ..... 62/470, 471, 472, 62/513, 192, 510

(56) References Cited

U.S. PATENT DOCUMENTS 3,336,762 A * 8/1967 Patterson ..... 62/84
3,777,509 A * 12/1973 Muench ..... 62/470
4,394,113 A * 7/1983 Bammert ..... 418/98
4,419,865 A * 12/1983 Szymaszek ..... 62/193
4,478,054 A * 10/1984 Shaw et al. ..... 62/323.4
4,497,185 A * 2/1985 Shaw ..... 62/468
4,748,820 A * 6/1988 Shaw ..... 62/175
5,016,447 A * 5/1991 Lane et al. ..... 62/470
5,042,271 A * 8/1991 Manz ..... 62/473
5,182,919 A * 2/1993 Fujiwara ..... 62/193
5,199,271 A * 4/1993 Ewer ..... 62/84
5,570,583 A * 11/1996 Boehde et al. ..... 62/84
5,884,494 A * 3/1999 Okoren et al. ..... 62/126
6,182,467 B1 2/2001 Zhong et al.
6,216,474 B1 4/2001 Sishtla
6,550,258 B1 4/2003 Shoulders

* cited by examiner

*Primary Examiner*—William E. Tapolcai
*Assistant Examiner*—Mohammad M. Ali
(74) *Attorney, Agent, or Firm*—Carlson, Gaskey & Olds

(57) ABSTRACT

A vaporizer for boiling off a liquid refrigerant from a combined liquid refrigerant/lubricant mixture tapped from an evaporator utilizes hot compressed gaseous refrigerant tapped from a location upstream of the condenser. In a preferred embodiment, the refrigerant is tapped from a compression chamber within the compressor. The hot refrigerant efficiently boils the liquid refrigerant out of the mixture, ensuring high viscosity lubricant. In further features, a return lubricant line from the compressor passes into a sump to further boil off liquid refrigerant.

25 Claims, 3 Drawing Sheets

OIL RECOVERY AND LUBRICATION SYSTEM FOR SCREW COMPRESSOR REFRIGERATION MACHINE

BACKGROUND OF THE INVENTION

This application relates to an efficient and effective method of recovering oil, and ensuring high viscosity oil for a refrigerant compressor.

In the prior art, refrigerant cycles typically include a compressor delivering compressed refrigerant to a condenser. From the condenser, the refrigerant travels to an expansion valve, and then to an evaporator. From the evaporator, the refrigerant returns to the compressor to be compressed.

The compressor is typically provided with lubricant, such as oil, which is utilized to lubricate bearing and other running surfaces. The oil mixes with the refrigerant, such that the refrigerant leaving the compressor includes a good quantity of oil. This is somewhat undesirable, as in the closed refrigerant system, it can sometimes become difficult to maintain an adequate supply of lubricant to lubricate the compressor surfaces. In the past, oil separators have been utilized immediately downstream of the compressor. While oil separators do separate the oil, they have not always provided fully satisfactory results. As an example, the oil removed from such a separator will be at a high pressure, and may have an appreciable amount of refrigerant still mixed in with the oil. This lowers the viscosity of the oil. The use of a separator can also cause a pressure drop in the compressed refrigerant, which is also undesirable.

Further, electric heaters have been utilized to vaporize the liquid refrigerant from the oil. However, the use of an electric heater has energy costs that are somewhat undesirable.

In some proposed systems, the combined lubricant and oil has been exposed to a concentrator or vaporizer for boiling off the liquid refrigerant from the oil. In the proposed system, a portion of the liquid refrigerant leaving the condenser passes through the concentrator and is brought into a heat transfer relationship with the combined liquid refrigerant/oil mixture. The refrigerant from the condenser is intended to cause the liquid refrigerant to evaporate and thus "boil" out of the combined liquid refrigerant/oil mixture.

This system is not as effective as it could be because it relied upon a refrigerant tapped from the condenser which was for the most part liquid. The cooling that occurred in the concentrator was thus sensible cooling (a non-phase change cooling). Hence, the temperature of the warmer refrigerant/oil mixture approaches the temperature of the "cool" refrigerant tapped from the condenser. This results in a lower average temperature for the heat exchanger, and thus less effective boiling of refrigerant/oil mixture.

SUMMARY OF THE INVENTION

In a disclosed embodiment of this invention, compressed gaseous refrigerant is tapped preferably upstream of the condenser and passed into an oil reclaim vaporizer. Preferably, this invention is included for use with a screw compressor. This refrigerant is at a much higher temperature than in the prior art, and thus efficiently boils the refrigerant out of the liquid refrigerant/oil mixture. Also, since the refrigerant is generally gaseous, use can be made of the latent heat of condensation to provide a larger average temperature difference between the heat source and the refrigerant/oil mixture. Stated another way, the compressed gas is condensed in the vaporizer from a gas to a liquid. Rather than just being cooled to a lower temperature to extract heat, it is condensed at a nearly constant temperature. Preferably, an orifice or other flow control device is positioned in a return line downstream of the vaporizer for this tapped refrigerant. The orifice causes a nearly constant pressure as the tapped refrigerant flows through the vaporizer, resulting in a higher average temperature difference between the heat source tapped refrigerant and the oil/refrigerant mixture. Thus, this method more efficiently boils out the refrigerant. The latent heat capacity of the tapped compressed gas is between one and two orders of magnitude higher than that available by sensibly cooling the refrigerant in the liquid state as was the case in the prior art. The heat transfer coefficients associated with condensation are much higher than those associated with sensible (non-phase change) cooling. Hence, this invention is far more effective at boiling off the excess refrigerant from the mixture. With regard to this feature, it should be understood that while the tapped refrigerant is preferably as high a percentage of gas as possible, it is always possible that some liquid might also be entrained. Thus, when this application speaks of a tapped, compressed gas, it should not be understood that the tapped refrigerant need not be entirely gas.

In one preferred embodiment, the refrigerant is tapped immediately downstream of the compressor. In a second embodiment, the refrigerant is tapped within one of the last compression chambers or closed lobes of a screw compressor.

In at least some possible embodiments, refrigerant could be tapped from the condenser, as long as it was tapped from a point in the condenser at which the refrigerant is still at a compressed pressure, and still has a very high percentage of gas. In any of these embodiments, in the vaporizer, the tapped refrigerant is physically separated from the refrigerant/oil mixture.

To provide further heat to boil off a portion of refrigerant, oil delivered to the compressor bearings is heated in the compressor, and returned directly to an oil sump to further boil off refrigerant. Prior to entering the bearings, this oil passes through an orifice, where its pressure is reduced. This process causes a portion of the liquid refrigerant mixed with the oil to flash to a vapor state, further enhancing the viscosity of the oil delivered to the bearings. This oil is heated as it cools the bearings, and the warmed oil is used to further boil off refrigerant. The oil is taken from this sump and returned to the compressor for lubricating the compressor surfaces.

The basic system outlined above has advantages over the prior art in that the separated oil is at a low pressure associated with the evaporator. Oil/refrigerant mixtures at low pressures are generally at higher viscosity than mixtures in prior systems using separators. In such systems, the oil will be at a high pressure. Further, the use of heated refrigerant gas from the compressor ensures more efficient boiling off of the refrigerant than the prior art.

In further features, there may be a restriction or a valve on a line leading from the evaporator to control the flow of the liquid refrigerant/oil being sent into the still or evaporator. Also, there may be plural, separately controlled lines from the evaporator to control the combined flow.

These and other features of the present invention can be best understood from the following specification and drawings, the following of which is a brief description.

DETAILED DESCRIPTION OF THE PREFERRED EMBODIMENT

Figure 1:
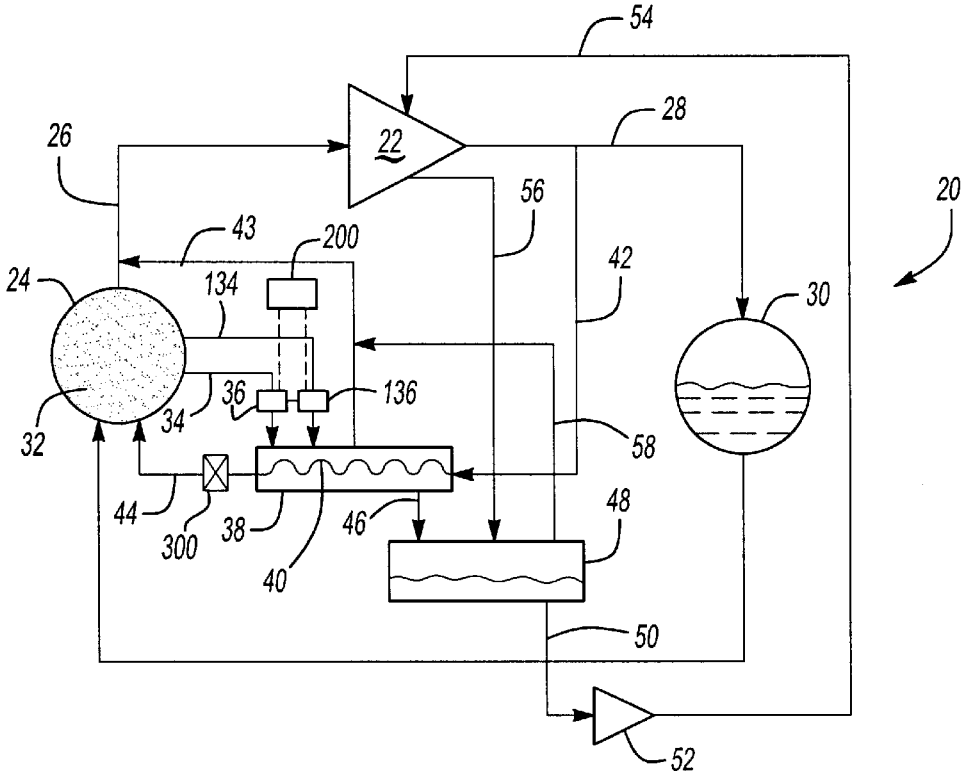
FIG. 1 is a schematic view of an inventive system.

FIG. 1 shows a refrigerant system 20 including a compressor 22. The present invention provides particular benefits for screw compressors, although certain aspects of this invention would also be beneficial in other type compressors.

As is known, a flooded style evaporator 24 delivers a refrigerant to the compressor 22 through a passage 26. From the compressor 22, the refrigerant passes through a line 28 to a condenser 30. Compressed, gaseous refrigerant is cooled in the condenser, transferred into a liquid phase and passes through an expansion valve (not shown) on its way to the evaporator 24. At the evaporator 24, an environment to be cooled is cooled by the refrigerant in the evaporator 24. As shown, it is typical that liquid refrigerant 32 settles from the refrigerant at the evaporator 24.

Generally, the most desirable viscosity range for a lubricant supplied to a compressor may vary with regard to the particular compressor. A worker of ordinary skill in the art would recognize this. In the case of refrigerant R-134a and 220 weight POE oil, peak viscosity occurs when the temperature of the refrigerant and oil mixture is approximately 40° F. warmer than the saturation temperature of the refrigerant corresponding to the mixture pressure.

It is also known that lubricant, typically oil, is supplied to the compressor 22. This oil is mixed with the refrigerant such that the liquid refrigerant 32 at the evaporator 24 includes a high quantity of oil. The present invention facilitates the separation of this liquid refrigerant from the oil such that the oil being returned to an oil sump 48 is relatively free of refrigerant. This increases the viscosity of the oil, and makes it more useful in lubricating the surfaces of the compressor.

To that end, a return line 34 passes the mixture 32 into a vaporizer 38. A valve or restriction 36 controls the flow from the line 34. A simple restriction can meter the return flow to the vaporizer, while a shut-off valve can allow a control 200 to open or close the flow.

Secondary tap 134 and valve 136 can also be controlled by control 200. The valves 36 and 136 can be opened serially dependent upon the volume of mixture 32 within the evaporator 24, and the capacity of the vaporizer 38 to process and vaporize the liquid refrigerant. Although two taps and valves are shown, it is within the teachings of this invention that even further taps and valves could be included.

Within the vaporizer is a line 40 which receives a hot, compressed, gaseous refrigerant from a tap 42. Generally, the vaporizer is a heat exchanger containing elements that physically separate the hot tapped refrigerant from the refrigerant/oil mixture. Line 40, which is shown schematically, would really preferably be a plurality of enhanced copper heat exchange tubes. Alternatively, the vaporizer could be other heat exchanger designs such as brazed plate or a tube-in-tube heat exchanger. Some embodiments are shown below. Generally, the tapped refrigerant is cooled and condensed to a liquid state and boils the liquid refrigerant from the mixture supplied into the vaporizer 38 through the line 34. Having the refrigerant/oil in the vaporizer at evaporator pressure ensures the mixture is at a lower temperature than the compressed gas used as the heat source. A refrigerant return line 44 is returned into the mixture 32 downstream of the vaporizer 38. An orifice or other flow restriction device 300 is located at the return line 44 to ensure a nearly constant pressure and temperature condensation process across the vaporizer on the tapped refrigerant. As shown in FIG. 1, the tap 42 is tapped upstream of the condenser such that the refrigerant is relatively hot, and is particularly hot when compared to the prior art. The mixture in the vaporizer exposed to the hot refrigerant through the line 40 causes refrigerant to boil out of the mixture and be returned through line 43 to the line 26 leading back to the compressor. Line 43 also serves as a vent ensuring the refrigerant/oil in the vaporizer is at the evaporator pressure. Having the refrigerant/oil in the vaporizer at evaporator pressure ensures that the mixture is at a lower temperature than the compressed gas used as the heat source. The oil is returned through a line 46 to the oil sump 48. From the oil sump 48, the oil passes through a line 50 to an oil pump 52, and through a line 54 back to the compressor. The oil, having lubricated surfaces within the compressor (not shown) returns through a lubricant return line 56 back to the sump 48. This return oil will be relatively hot having lubricated working surfaces in the compressor. This hot oil will further serve to boil off additional refrigerant from the oil in the sump 48. That is, the vaporizer 38 will serve to remove a good deal of the liquid refrigerant, however, the return hot oil 56 will remove even more liquid refrigerant from the oil sump 48. This removed liquid refrigerant will pass through a line 58 back into the line 43, and line 26.

The present invention improves upon the prior art by utilizing a much hotter refrigerant to boil the liquid refrigerant from the liquid refrigerant/oil mixture. Thus, more efficient removal of this liquid refrigerant is performed than was the case in the prior art.

Figure 2:
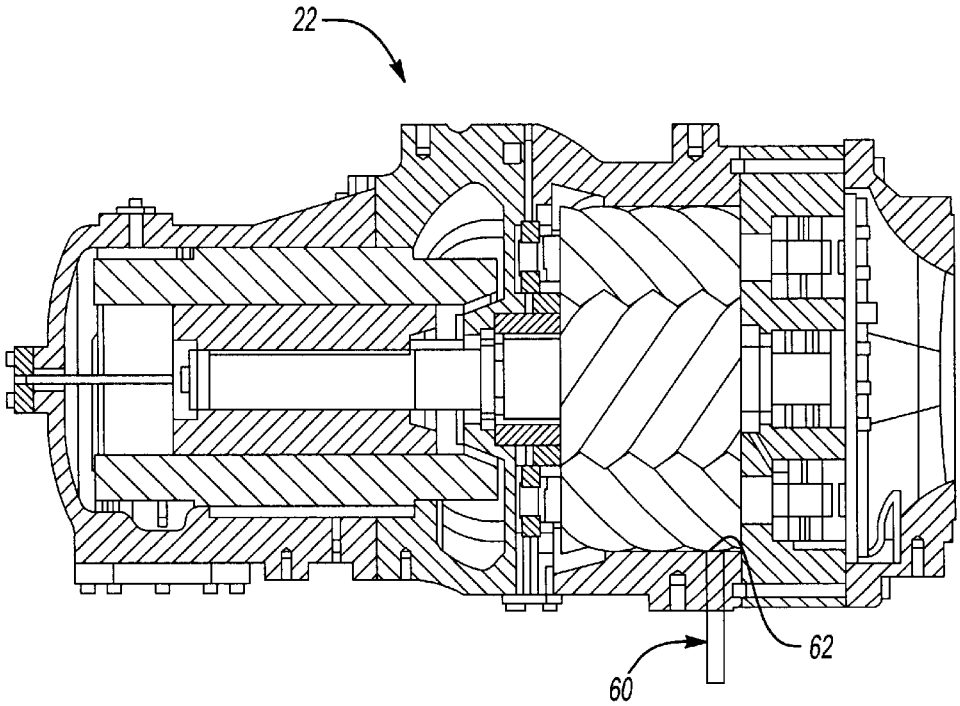
FIG. 2 is a view of a second embodiment of the FIG. 1 system.

FIG. 2 shows another embodiment wherein the tap 60 taps into the last closed lobe 62 of the scroll compressor 22. That is, here, the discharge refrigerant tapped to the vaporizer 38 is actually taken from a compression chamber. This will be a particularly hot location under most operational characteristics. One preferred application of the tapping is disclosed in co-pending U.S. patent application Ser. No. 10/3 (6,326 filed on even date herewith, and entitled "Alternate Flow of Discharge Gas to a Vaporizer for a Screw Compressor."

Figure 3:
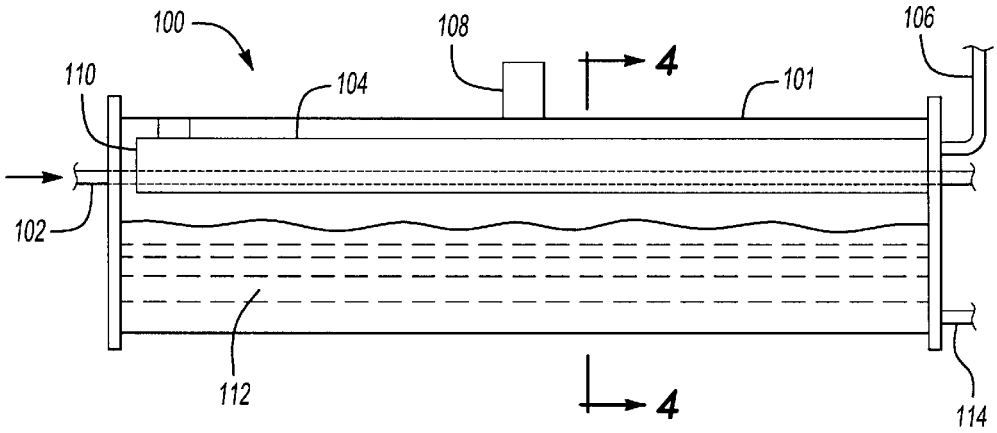
FIG. 3 shows another embodiment.
Figure 4:
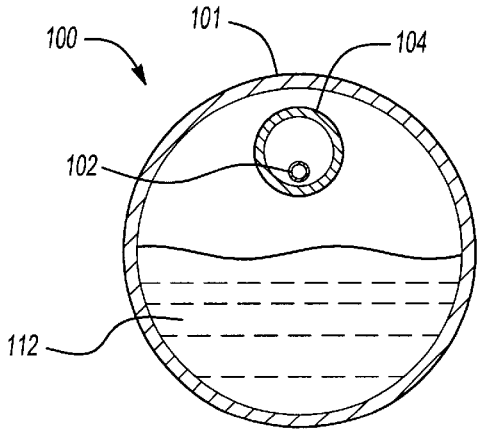
FIG. 4 is a cross-sectional view along line 4—4 of FIG. 3.

A further embodiment 100 is shown in FIG. 3. The tapped discharge refrigerant passes through a passage 102 through a vaporizer tube 104. The combined liquid refrigerant/oil passes through a passage 106 into the vaporizer 104. An end 110 of the vaporizer allows the oil to pass into the oil sump 112, which surrounds the still 104. The return oil line 114 passes to the oil pump. The separated liquid refrigerant passes through the line 108 back to the suction line of the compressor.

Figure 5:
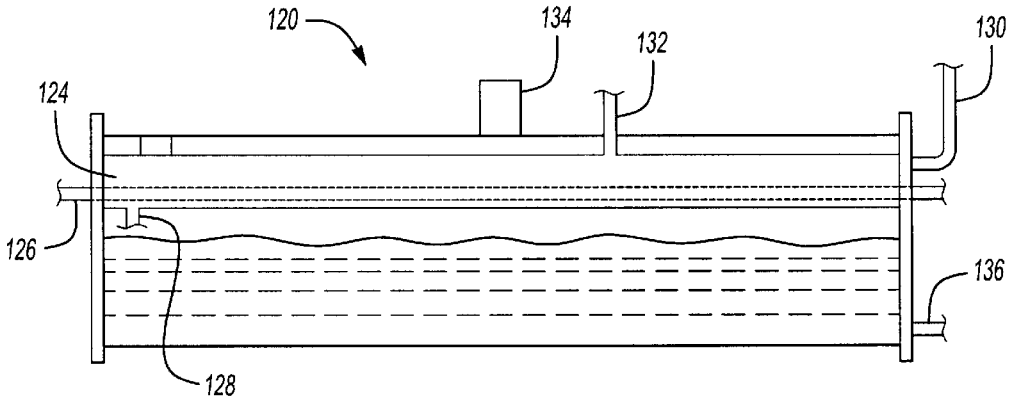
FIG. 5 shows yet another embodiment.

Another embodiment 120 is shown in FIG. 5. FIG. 5 is similar in most respects to FIG. 3, however, an oil vent 128 is formed in the bottom of the vaporizer 124 and a gas vent 132 extends through the outer wall 122 of the oil sump. Vent 134 is also formed through the oil sump to return further separated refrigerant. Again, the liquid refrigerant/oil passes into the vaporizer 124 through the passage 130. Heated compressed refrigerant passes through the line 126, and the separated oil passes through the line 136 back to the oil pump.

Further, an electric heater could be provided associated with the vaporizer to vaporize the liquid refrigerant when the normal use of the heated refrigerant as set forth in this application is shut down, or is insufficient for some other reason.

Figure 6:
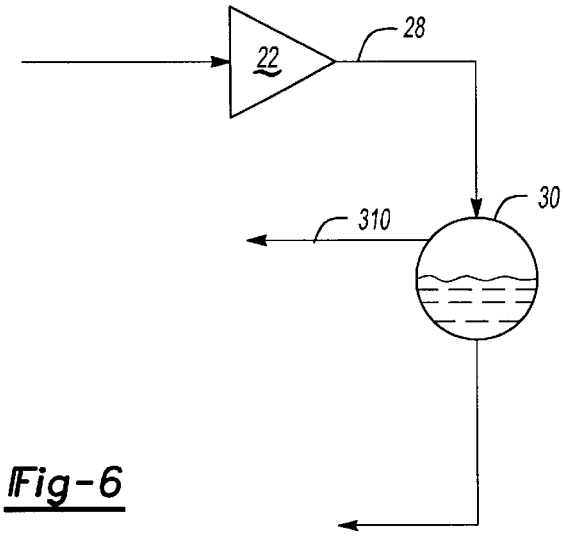
FIG. 6 shows yet another embodiment.

While the preferred embodiments show the tap occurring upstream of the condenser, it is possible that a hot, gaseous compressed refrigerant could also be tapped from an early portion of the condenser. FIG. 6 schematically shows an condenser 30 receiving the compressed refrigerant 28 from the compressor, and having a tap 310 schematically at an early stage at which there is still likely to be a good deal of gaseous compressed refrigerant available. A worker of ordinary skill in this art would recognize how to obtain such gaseous refrigerant from an early point in the condenser 30.

Although preferred embodiments of this invention have been disclosed, a worker of ordinary skill in this art would recognize that many modifications would come within the scope of this invention. For that reason the following claims should be studied to determine the true scope and content of this invention.

What is claimed is:

1. A refrigerant cycle comprising;

a refrigerant compressor for receiving refrigerant from an evaporator, compressing the refrigerant, and passing the refrigerant to a condenser;

a lubricant being supplied to said compressor;

a passage for tapping a liquid refrigerant/lubricant mixture from said evaporator into a vaporizer; and a tap for tapping compressed refrigerant from a location upstream of said condenser into said vaporizer, said compressed refrigerant being maintained separate from said refrigerant/lubricant mixture and preventing from mixing with said refrigerant/lubricant mixer while in said vaporizor, and said compressed refrigerant heating said combined liquid refrigerant/lubricant mixture, and boiling liquid refrigerant out of said mixture.

2. A refrigerant cycle as set forth in claim 1, wherein there are two passages passing combined liquid refrigerant/lubricant mixture to said vaporizer.

3. A refrigerant cycle as set forth in claim 2, wherein selectively controlled valves are placed on each of said at least two passages.

4. A refrigerant cycle as set forth in claim 1, wherein a restriction is placed on said passage leading from said evaporator to said vaporizer.

5. A refrigerant cycle as set forth in claim 1, wherein said compressed refrigerant is tapped at a location between said compressor and said condenser.

6. A refrigerant cycle as set forth in claim 1, wherein said discharge refrigerant is tapped from a location within a compressor chamber.

7. A refrigerant cycle as set forth in claim 6, wherein said compressor is a screw compressor and said refrigerant is tapped from the last closed lobe of said screw compressor.

8. A refrigerant cycle as set forth in claim 1, wherein said lubricant is delivered from a sump to said compressor, and returned at a higher temperature from said compressor to said sump, said returned lubricant causing further refrigerant to be boiled out of said liquid refrigerant/lubricant mixture, and said boiled off refrigerant from said sump being returned to an inlet line for said compressor.

9. A refrigerant cycle as set forth in claim 8, wherein said boiled off refrigerant is returned to an inlet line for said compressor upstream of said evaporator, and the line returning said boiled off refrigerant acts as a vent to ensure the portion of said vaporizer that receives said refrigerant/oil mixture is essentially at the evaporator pressure.

10. A refrigerant cycle as set forth in claim 1, wherein said lubricant delivered to said compressor is delivered from a sump, and lubricant from said vaporizer is delivered into said sump.

11. A refrigerant cycle as set forth in claim 10, wherein said sump surrounds said vaporizer.

12. A refrigerant cycle as set forth in claim 1, wherein said compressor is a screw compressor.

13. A refrigerant cycle as set forth in claim 1, wherein said tapped compressed refrigerant is generally in a gaseous state.

14. A refrigerant cycle as set forth in claim 13, wherein there is a return line for said tapped refrigerant to return said tapped refrigerant to a refrigerant flow line, and downstream of said vaporizer, said return line including a fluid flow component which ensures the pressure on said tapped refrigerant through said vaporizer is relatively constant.

15. A refrigerant cycle comprising:

a compressor for compressing refrigerant and delivering a refrigerant to said condenser, said refrigerant passing from said condenser to an evaporator, and from said evaporator back to said compressor;

a lubricant cycle for delivering lubricant from a sump through a pump and to said compressor;

a passage for tapping a combined liquid refrigerant/lubricant mixture from said evaporator into a vaporizer, and tapping a compressed gaseous refrigerant into said vaporizer, said compressed refrigerant being maintained separate from said refrigerant/lubricant mixture and preventing from mixing with said refrigerant/lubricant mixer while in said vaporizor, and said tapped refrigerant causing said liquid refrigerant to boil out of said liquid refrigerant/lubricant mixture, said removed lubricant passing into said sump, and said boiled off liquid refrigerant being returned to a line leading to said compressor.

16. A refrigerant cycle as set forth in claim 15, wherein there are two passages passing combined liquid refrigerant/lubricant mixture to said vaporizer.

17. A refrigerant cycle as set forth in claim 16, wherein selectively controlled valves are placed on each of said at least two passages.

18. A refrigerant cycle us set forth in claim 15, wherein a restriction is placed on said passage leading from said evaporator to said vaporizer.

19. A refrigerant cycle as set forth in claim 15, wherein said compressed refrigerant is tapped at a location between said compressor and said condenser.

20. A refrigerant cycle as set forth in claim 15, wherein said discharge refrigerant is tapped from a location within a compressor chamber.

21. A refrigerant cycle as set forth in claim 15, wherein said compressor is a screw compressor and said refrigerant is tapped from a last closed compression chamber of said screw compressor.

22. A refrigerant cycle as set forth in claim 15, wherein said refrigerant is tapped from an early portion of said evaporator wherein gaseous compressed refrigerant is still readily available.

23. A refrigerant cycle as set forth in claim 15, wherein said lubricant is delivered from a sump to said compressor, and returned from said compressor to said sump, said returned lubricant causing further refrigerant to be boiled out of said liquid refrigerant/lubricant mixture, and said boiled off refrigerant from said sump being returned to an inlet line for said compressor.

24. A refrigerant cycle as set forth in claim 15, wherein said lubricant delivered to said compressor is delivered from a sump, and lubricant from said vaporizer is delivered into said sump.

25. A refrigerant cycle as set forth in claim 15, there is a return line for said tapped refrigerant to return said tapped refrigerant to a refrigerant flow line, and downstream of said vaporizer, said return line including a fluid flow component which ensures the pressure on said tapped refrigerant through said vaporizer is relatively constant.

* * * * *

UNITED STATES PATENT AND TRADEMARK OFFICE

CERTIFICATE OF CORRECTION

PATENT NO. : 6,672,102 B1
DATED : January 6, 2004
INVENTOR(S) : Huenniger et al.

It is certified that error appears in the above-identified patent and that said Letters Patent is hereby corrected as shown below:

Column 6,
Line 45, “us” should read -- as --

Signed and Sealed this

Twentieth Day of April, 2004

JON W. DUDAS
*Acting Director of the United States Patent and Trademark Office*